United States Patent [19]

Currie

[11] 3,997,171

[45] Dec. 14, 1976

[54] GOLF CLUB WITH SPRING WING DEFLECTOR

[76] Inventor: Gaylord Lee Currie, 631 Country Plaza S. Gilbert, Tempe, Ariz. 85234

[22] Filed: Nov. 13, 1975

[21] Appl. No.: 631,749

Related U.S. Application Data

[63] Continuation-in-part of Ser. No. 254,695, May 18, 1972, abandoned.

[52] U.S. Cl. ..... 273/167 A; 273/174

[51] Int. Cl.[2] ..... A63B 53/04

[58] Field of Search ..... 273/77 R, 164, 167–175, 273/193 R, 194 R, 78

[56] References Cited

UNITED STATES PATENTS

| | | | |
|---|---|---|---|
| 1,452,845 | 4/1923 | Pryde | 273/169 |
| 1,945,844 | 2/1934 | Young | 273/174 |
| 1,975,822 | 10/1934 | Young | 273/174 |
| 2,328,583 | 9/1943 | Reach | 273/171 |
| 2,478,468 | 8/1949 | Drake | 273/167 A X |
| 2,838,312 | 6/1958 | Drake | 273/193 R X |
| 3,138,386 | 6/1964 | Onions | 273/174 X |
| 3,220,733 | 11/1965 | Saleeby | 273/171 |

FOREIGN PATENTS OR APPLICATIONS

| | | | |
|---|---|---|---|
| 20,698 | 9/1913 | United Kingdom | 273/167 A |
| 24,834 | 11/1903 | United Kingdom | 273/174 |
| 29,603 | 12/1913 | United Kingdom | 273/167 A |
| 448,870 | 6/1936 | United Kingdom | 273/167 A |

*Primary Examiner*—Richard J. Apley
*Attorney, Agent, or Firm*—Herbert L. Martin

[57] ABSTRACT

A golf club is provided with a spring flange or wing attached to the bottom of the head in such a manner that it has flexibility both lengthwise and crosswise of the head. This spring wing converts the club into an all purpose wedge which is particularly useful in pitching and in sand. The wing is preferably slotted inwardly from its trailing edge to give it additional flexibility on striking the sand or turf.

9 Claims, 6 Drawing Figures

GOLF CLUB WITH SPRING WING DEFLECTOR

This application is a continuation-in-part of my former pending application Ser. No. 254,695 filed May 18, 1972 now abandoned.

This invention relates to golf clubs, and more particularly to a construction which converts a conventional club to an all purpose wedge. Pitching wedges and sand wedges are known in the art, but generally have been considered too different to be combinable in a single club.

It is accordingly an object of the invention to provide a club which not only serves as a good sand wedge, but further constitutes a good distance club from about 100 yards into the green as well as a fine club around the green.

Other objects and advantages of the invention will become apparent to those skilled in the art from the following description taken in conjunction with the accompanying drawing in which.

Figure 1:
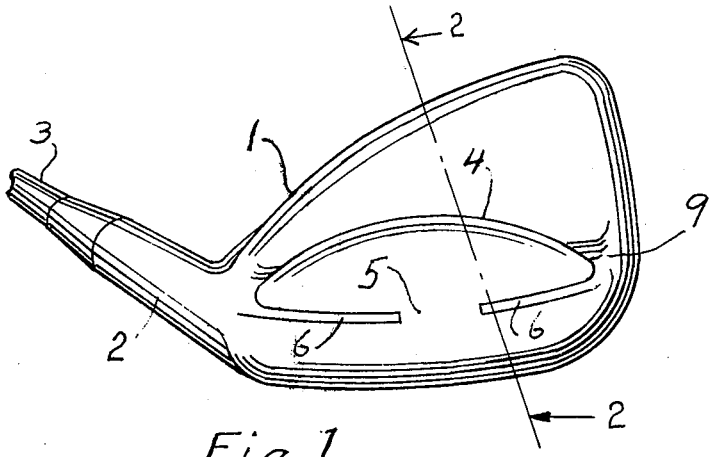
FIG. 1 is an elevational view of the bottom of the club showing the position of the spring wing and its mode of attachment to the head.
Figure 2:
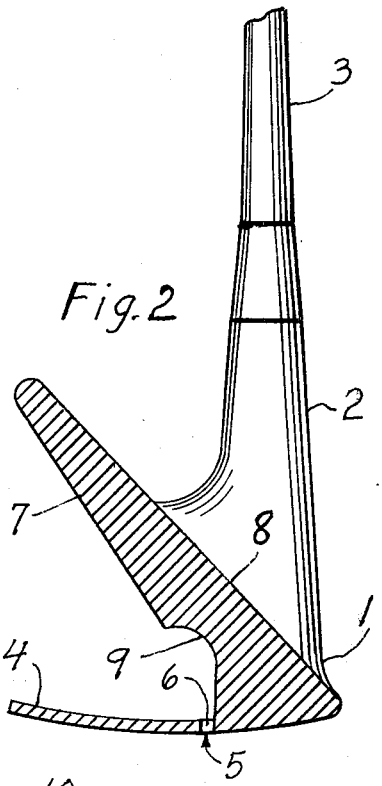
FIG. 2 is a sectional view taken on line 2—2 of FIG. 1.

Considering FIGS. 1 and 2, head 1 has a shank 2 thereon which is adapted to receive shaft 3 in a known manner. Attached to the bottom of the head, preferably integral therewith or welded thereto, is a wing 4, the generally flat fan shape of which is better shown in FIG. 1. It is contemplated that this wing may be attached to the head in any desired manner, as by machine screws, rivets or the like, and that it may be constructed of metal, plastic or any other material having the necessary resilient properties. In order to increase the two-way flexibility of wing 4, it may be attached to the head by a relatively narrow bight 5, thereby forming slots 6 to either side thereof. The blade 7, having face 8 thereon, may be slightly channeled as at 9 to lighten the head and to slightly raise the center of gravity.

The purpose of the spring wing is to provide a deflector sole which will absorb bounce on all shots and prevent "plowing in" of the blade, particularly on sand shots.

At this point it is desired to elaborate on the meaning of the word "spring" as used in the term "spring wing". As in the above mentioned parent case, the term "spring" is intended to be used in its recognized and generally accepted sense in the mechanical arts. The Webster's Dictionary defines the term spring as "an elastic body — that recovers its original shape when released after being distorted". This is the sense in which the term is applied here. It behaves in accordance with Hooke's Law in that it will undergo substantial distortion within its elastic limit and thereafter recover its original shape. The term is not intended to connote the infinitesimal distortion which is detectable in a normally rigid body when subjected to great stress. For example, the rails of a railroad track will be observed to flex downwardly as the locomotive wheels pass thereover and to thereafter recover their original position, but these rails could not be termed "springs" within the accepted meaning of the term. Applicant's wing is made of a thin piece of material, preferably spring steel, which undergoes very substantial deflection upon impact with the ground or turf. In normal use this deflection will be of the order of magnitude of one-quarter inch for each inch of length of the wing. In this case the length of the wing will be considered the distance between its trailing edge and its point of attachment to the head. Thus the trailing edge of a wing that measures one and one-half inch in length could be flexed three-eights of an inch or even more. The force necessary to produce this amount of deflection will depend on the distance between the point of application of that force and the point of attachment of the wing, as well as the modulus of elasticity of that particular wing, but generally speaking, a force of one pound applied to the trailing edge of a one and one-half inch wing should produce a deflection of at least one thirty-second of an inch. Deflection of the trailing edge of less than one sixteenth inch would be substantially ineffective to accomplish the intended function. Nor would it perform such intended function if it were constructed to be "bendable to vary its effective angle to the said plate", as in the prior art of Onions, U.S. Pat. No. 3,138,386, for example.

The modulus of elasticity of the spring wing of a particular club will be so chosen as to adapt the club to the strength and habits of a particular player. For example, a frail person may require a different modulus of elasticity than would a more vigorous person, for the most favorable results. In other words, the modulus of elasticity chosen for a particular club should be matched as nearly as possible with the vigor of the player using that club in order that the range of deflection of the spring wing will generally match the range of force applied to the club, and hence the range of impact forces to which the club may be subjected by a particular player. In any event, for a given elasticity, the two-way flexibility, i.e., both parallel with and normal to the line of travel of the club, adapts it very well for widely varying conditions of use such as different angles at which the club is held, as well as the degree of opening of the blade on a swing. While the angle of the wing with respect to the blade is not critical, it may be found that different players get better results with different angles.

In actual use, it has been found that added localized flexibility, and consequently greater accuracy, can be acquired by providing the wing with slits of various patterns. Thus in FIGS. 3 to 6 are shown four different slit patterns which accomplish these ends. These Figures show only the wings detached from the head at bight 5.

Figure 3:
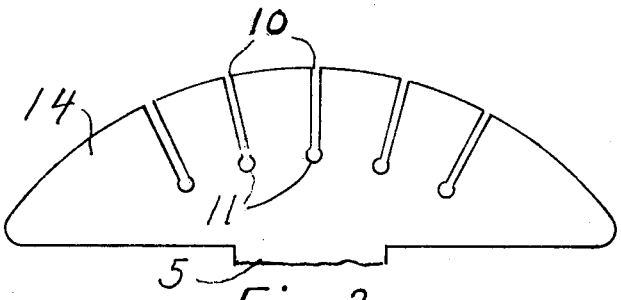
FIG. 3 shows a modified construction on a larger scale of a spring wing wherein narrow slots are cut inwardly of the trailing edge to provide increased flexibility.

FIG. 3 shows the modified wing 14 provided with radially oriented slits which divide the wing into a plurality of relatively independent sole panels. These slits are cut from the arcuate trailing edge of the wing, inwardly to previously drilled holes which serve, in a well known manner, to permit relative flexing of adjacent panels without fatigue fracture beyond the inner ends of the slits. The width of the slits is preferably just great enough to permit relative flexing of the panels. Unnecessarily wide slits would merely decrease the sole area of the panels. Nor are the slit depths critical, it being apparent that the deeper the slits, the greater will be the flexibility of the panels. Thus different depths of slits provide different stages of absorbtion of downward motion of a club against the ground. By thus giving independent flexibility to different areas of the wing, the adverse effect of the wing striking a small hard object or ground portion, is minimized.

Figure 4:
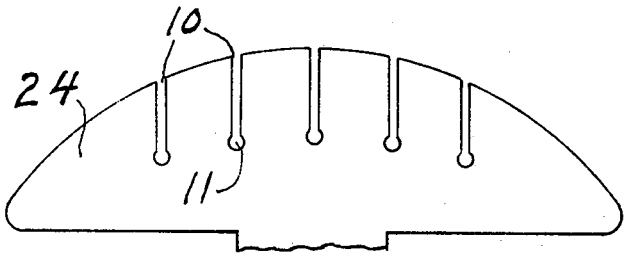

In the FIG. 4 modification, the parallel slits of wing 24 define more or less parallel sole panels which might be preferable to a player who has acquired a higher degree of skill for uniformity of swing.

Figure 5:
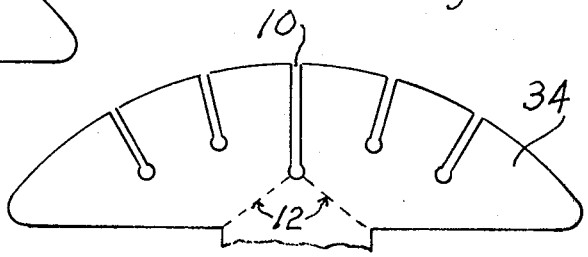
FIGS. 4–6 are fragmentary views similar to that of FIG. 3 but showing three additional modifications of the slotted spring wing.

In the FIG. 5 construction the centrally disposed slit 10 on wing 34 divides the wing into two major sole panels which may flex mainly about flexure lines 12. The remaining slits merely serve to provide localized flexure of portions of these major panels.

Figure 6:
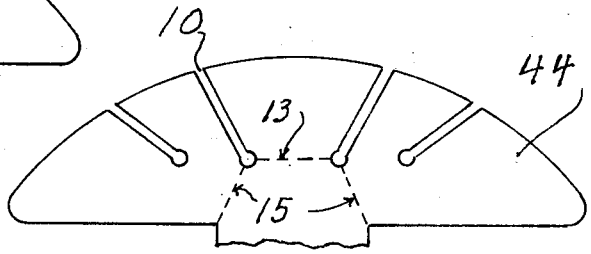

FIG. 6 shows wing 44 provided with a slit pattern which gives the wing three major sole panels, the central one extending in fan-tail relation to the direction of swing, thus flexing about flexure line 13, while the slitted side panels may independently flex about flexure lines 15.

Since the different slit patterns will give slightly different results, depending on how the club is held, as well as other habits of the individual player, pattern preference may differ widely among different players. Whatever the degree of refinement in this respect, however, the main advantage by far is the over all effect of the spring wing on the shot. A club so constructed, being light and having a little more loft than a pitching wedge, thus becomes an excellent club around the green. When the blade is opened slightly, the spring wing absorbs about 75% of any mistake made in hitting behind the ball. It also makes it much easier to play a good shot from a thin or bare lie. Chilly dipping, fluffing, or stubbing a short shot would be very rare with this club. The spring wing makes it possible to play a short pitch off a bare lie as if it had a half inch of good turf underneath. Furthermore, as a sand wedge, the large area of the sole holds the blade a little shallower, thereby making it take less effort to come out of sand while at the same time making long sand shots easier. The spring effect also absorbs and lessens mistakes in the sand. On all shots, the spring wing absorbs bounce, thereby shortening the roll of the ball.

An interesting side effect of the resilient wing construction is that the spring steel wings often produce an audible sound effect on impact which varies somewhat with the manner in which the club strikes the ground or turf. Players are thereby able in many instances to identify the character and quality of their swing by this sound.

It will thus be apparent that I have developed an all purpose wedge that adds to the enjoyment of golfing by facilitating the effectiveness of a swing under a multitude of varying situations and adverse conditions encountered on a golf course.

What I claim is:

1. In a golf club, an all purpose wedge comprising a head having a sole surface thereon and a shank adapted for attachment to a shaft, a blade on said head, and a flexible deflector comprising a thin spring wing of highly resilient properties attached to the rear surface of said head thereby forming a continuation of the sole surface of said head and extending rearwardly thereof and terminating in a trailing edge, said spring wing being of such high resiliency that upon impact with the ground or turf said wing will undergo a very substantial deflection directly proportional to the force of impact and thereafter recover its original shape, thereby yieldably resisting and absorbing downward movement of the club in direct proportion to said force of impact, the resiliency of said spring wing being such that in normal use, the wing may undergo a deflection, within its elastic limit, of at least one fourth inch for each inch of the distance between its point of attachment to the head and its trailing edge.

2. In a golf club, an all purpose wedge comprising a head having a sole surface thereon and a shank adapted for attachment to a shaft, a blade on said head, and a deflector comprising a spring wing of highly resilient properties attached to the rear surface of said head thereby forming a continuation of the sole surface of said head and extending rearwardly thereof, and terminating in a trailing edge, whereby upon impact with the ground or turf, the spring wing will yieldably resist and absorb downward movement of the club, said spring wing being elongated and attached only by a bight portion to the head midway of the ends of said wing, thereby providing flexible portions of said wing extending in both directions from said bight portion toward the heel and toe of said head.

3. The construction of claim 2 in which those end portions of the wing extending in both directions from said bight portion, form narrow slots between the near surface of the head and the adjacent wing portion.

4. The construction of claim 2 wherein the trailing edge of the wing is of continuous or uninterrupted contour.

5. In a golf club, a multiple purpose wedge comprising a head having a sole surface thereon and a shank adapted for attachment to a shaft, a blade on said head having an upwardly and rearwardly extending face thereon, a deflector wing attached to the rear surface of said head thereby forming a continuation of the sole surface of said head and extending rearwardly thereof and terminating in an arcuate trailing edge, said wing being divided into a plurality of separated sole panels by at least one slit extending inwardly of the trailing edge of said wing and completely vertically through said wing, and terminating a substantial distance horizontally into the wing.

6. The construction of claim 5 wherein a plurality of slits extend inwardly from the arcuate trailing edge of the wing in a generally radial direction.

7. The construction of claim 5 wherein a plurality of substantially parallel slits extend inwardly of said trailing edge in a direction generally parallel to the normal direction of travel of the club during a swing.

8. The construction of claim 5 wherein the wing is provided with a plurality of slits with a centrally disposed slit extending substantially deeper from the trailing edge than any other slits, thereby dividing the wing into two sole panels of substantially equal areas.

9. The construction of claim 5 wherein the wing is provided with a plurality of slits and the two innermost adjacent slits divide the wing into three major sole panels, the central panel of which fan tails in a direction substantially symmetrical with the normal direction of travel of the club.

* * * * *